US005836553A

United States Patent [19]

Bergaila

[11] Patent Number: 5,836,553

[45] Date of Patent: Nov. 17, 1998

[54] FOLDING BAG HOLDER

[76] Inventor: Steven W. Bergaila, 187 A Arlene Ct., Wheeling, Ill. 60090

[21] Appl. No.: 598,498

[22] Filed: Feb. 8, 1996

[51] Int. Cl.[6] ..... B65B 67/04

[52] U.S. Cl. ..... 248/99; 248/101; 248/95

[58] Field of Search ..... 248/99, 95, 101; 24/30.5 R, 30.5 P, 553

[56] References Cited

U.S. PATENT DOCUMENTS

| | | | |
|---|---|---|---|
| 310,210 | 1/1885 | Liedel | 248/101 |
| 347,077 | 8/1886 | Wealand | 248/101 |
| 637,248 | 11/1899 | Hagstrom | 248/101 |
| 3,180,384 | 4/1965 | Seifert | 248/95 |
| 4,287,701 | 9/1981 | Washington | 53/390 |
| 4,312,489 | 1/1982 | Paetzold | 248/97 |
| 4,470,627 | 9/1984 | Carroll | 294/55 |
| 4,488,697 | 12/1984 | Garvey | 248/101 |
| 4,738,478 | 4/1988 | Bean, Jr. | 294/55 |
| 5,020,751 | 6/1991 | Larkin . | |
| 5,275,490 | 1/1994 | Loebbert | 248/99 |
| 5,456,431 | 10/1995 | Ilnisky | 248/99 |

FOREIGN PATENT DOCUMENTS

| | | | |
|---|---|---|---|
| 4775123 | of 1988 | Canada | 248/99 |
| 4610039 | of 1986 | Sweden | 4/285 |

*Primary Examiner*—Ramon O. Ramirez
*Assistant Examiner*—Kimberly T. Wood

[57] ABSTRACT

A device for holding bags of a variety of sizes and shapes open to receive contents therein while also allowing for easy changing of bags. Bagholder and bag assembly also being rotatable about an axis to allow the mouth of the bag to close shut and to allow mounting and utilizing bagholder assembly on various horizontal, vertical, or angled surfaces so as to fold away when not in use, comprised of an annular bag support ring, a mating annular bag lock ring and a labyrinth-like passageway to trap and hold a bag, one or more support arm(s) extending co-planarly from the ring, an elongated cam attached to the arm(s), and a rotatable clamp with mounting plate to mount rings, arm, and elongated cam assembly to a suitable surface while allowing the assembly to rotate and index to a variety of positions.

1 Claim, 6 Drawing Sheets

FOLDING BAG HOLDER

BACKGROUND—FIELD

This invention relates to devices for holding open the mouths of flexible bags—specifically to an improved, easier-to-use, folding, space-saving bag holder.

BACKGROUND PRIOR ART

Several types of bag holders have been offered by the prior art that have attempted to secure a flexible bag to various hoops for the purpose of holding a bag with the mouth in an open position for receiving material into the bag. Some of them such as Borland, U.S. Pat. No. 4,775,123, Oct. 4, 1988 or Washington, U.S. Pat. No. 4,287,701, Sep. 8, 1981 or Bean Jr., U.S. Pat. No. 4,738,478, Apr. 19, 1988 did not tightly secure the bag to the hoop, resulting in the bag slipping or falling off when weighted with contents. Some, such as U.S. Pat. Nos. Garvey, 4,488,697, Dec. 18, 1984 or Paetzold 4,312,489, Jan. 26, 1982 or 4,470,627, Sep. 11, 1984 incorporated loose, separate retaining rings or straps which made it cumbersome to attach a bag which had to be held in place with one hand while trying to position and snap-in a ring around it with the other hand. Some of the prior art such as Larkin, U.S. Pat. No. 5,020,751, Jun. 4, 1991 needed separate lids or cover plates in order to provide a closure for the bag when not being used.

Some were suited for only one size of bag, thus preventing the use of any size bag available on hand. All had in-flexible rigid mounts to attach the hoop to a wall for example, which caused the hoop to protrude outward substantially from the wall making it unsuitable for use in more confined places as well as creating an obstacle to bump into or to trip over. None of them provided ways to universally mount the hoop onto surfaces of various angles other than vertical and to allow the unit to be rotated or moved to a plurality of postures for convenience of use.

OBJECTS AND ADVANTAGES

Therefore it is an object of this invention to provide a bag holder with improved, more secure bag holding devices, also in which the bag can be easily attached even by some handicapped people with limited manual dexterity. Another object is to provide a bag holder that will accept most commercially available sizes and shapes of bags and does not need a separate lid or cover to close the bag mouth. Another object is to provide a bag holder that swings or folds out of the way to take up less room by not protruding as far outward from a mounting surface making it suitable for use in small spaces and less of an obstacle or hazard. Another object is to provide a bag holder with a flexible mounting bracket to enable the bag holder to be mounted to a variety of horizontal, vertical, or angled surfaces, or to be hand carried about as needed.

These and other objects of this invention will become more fully apparent as this description proceeds, references being made to the accompanying drawings and appended claims.

DRAWING FIGURES

REFBRENCE NUMERALS IN DRAWINGS:

| | |
|---|---|
| 10 | Bag Holder assembly |
| 12 | Bag support ring |
| 14 | Support ring main channel |
| 16 | Central opening |
| 18 | Bag lock ring |
| 20 L + R | Flexible attaching and positioning arm |
| 22 L + R | Main support arm |
| 24 | Indexing mounting bracket assembly |
| 26 | Lock ring top surface |
| 28 L + R | Lock ring upper bottom surface |
| 30 L + R | Lock ring top side wall |
| 32 L + R | Lock ring bottom side wall |
| 34 L + R | Lock ring bottom surface |
| 36 | Groove |
| 38 L + R | Groove side wall |
| 40 | Groove top surface |
| 42 | Corners - lock ring |
| 44 | Support ring outer side wall |
| 46 | Support ring inner side wall |
| 48 L + R | Support ring top surface |
| 49 | Support ring bottom surface |
| 50 L + R | Channel side wall |
| 52 L + R | Channel bottom surface |
| 54 | Land |
| 56 L + R | Land sidewall |
| 58 | Land top surface |
| 60 | Corners - support ring |
| 62 | Labrinyth-like passageway |
| 64 L + R | Support ring protrusion |
| 66 | Protrusion radius |
| 68 L + R | Undercut area |
| 70 | Undercut radius |
| 72 | Support arm top surface |
| 74 | Support arm outside surface |
| 76 | Support arm inside surface |
| 78 | Support arm end surface |
| 80 | Support arm bottom surface |
| 82 | Elongated cam |
| 84 | Elongated cam lobes |
| 86 | Elongated cam profile |
| 88 | Fixed cam indexing clamp |
| 90 | Fixed clamp top surface |
| 92 | Fixed clamp bottom surface |
| 94 | Fixed clamp front surface |
| 98 A + B | Elongated cam receiving channel |
| 100 | Mounting plate |
| 102 | Mounting plate front surface |
| 104 | Mounting plate back surface |
| 106 | Mounting plate top surface |
| 108 | Mounting plate bottom surface |
| 112 | Mounting screw holes |
| 114 | Rib |
| 116 | Hole |
| 118 | Pivoting cam tensioning clamp |
| 120 | Pivoting clamp top surface |
| 122 | Pivoting clamp bottom surface |
| 124 | Pivoting clamp angled back surface - upper |
| 125 | Pivoting clamp angled back surface - lower |
| 126 | Pivoting clamp front surface |

-continued

| REFBRENCE NUMERALS IN DRAWINGS: | |
|---|---|
| 128 | Clearance hole |
| 130 | Pivot |
| 132 | Elongated cam cavity |
| 134 | Spring |
| 136 | Tensioning screw |
| 138 | Flexible arm top surface |
| 140 | Flexible arm bottom surface |
| 142 L + R | Flexible arm side surface |
| 144 | Flexible arm end surface |
| 146 | Flexible arm bend |
| 148 | Flexible arm angle |
| 150 | Flexible bag |

DESCRIPTION

Figure 1:
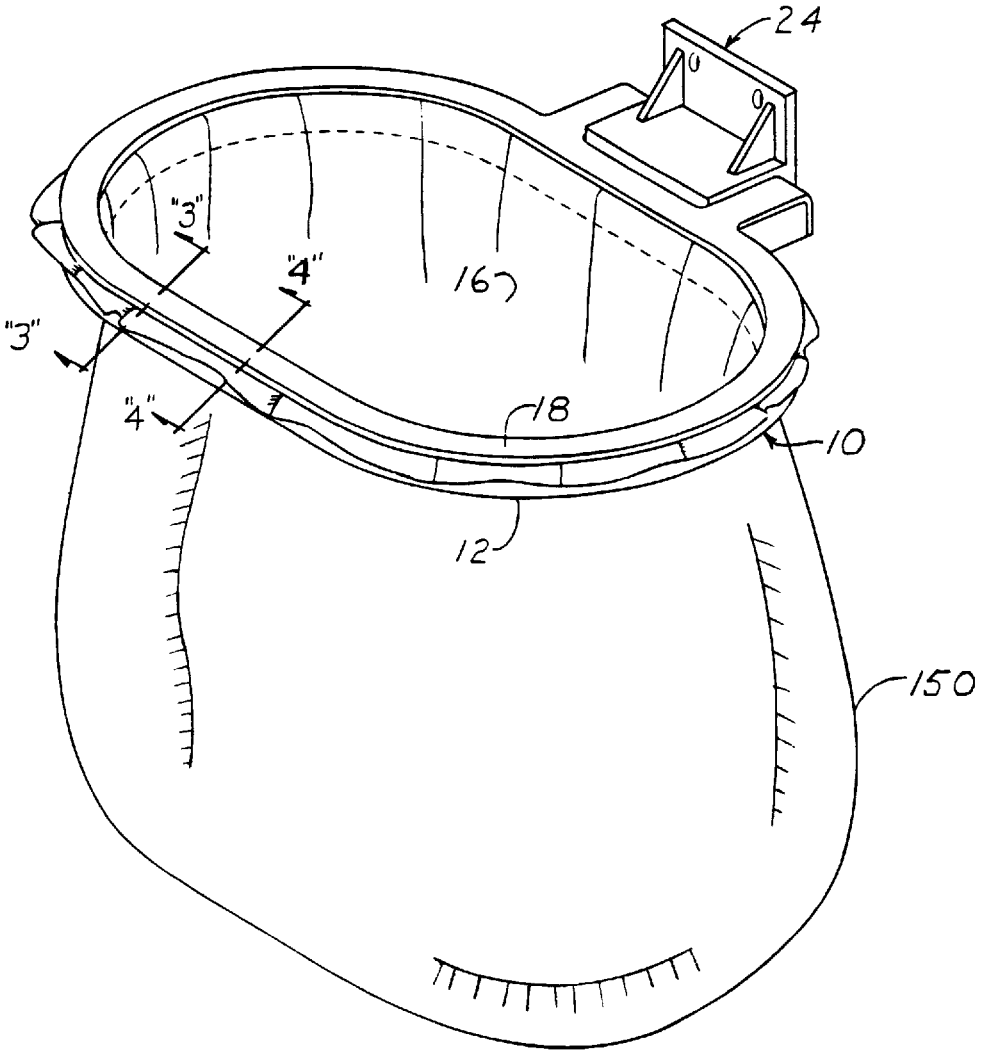
FIG. 1 shows a perspective view of a folding bag holder without bag, in a horizontal open position.

The device of FIG. 1 is a bag holder assembly 10 of the invention consisting of a generally oblong hoop-like main bag support ring 12, a flexible bag 150, a bag lock ring 18, a main central opening 16, and a rotatable indexing mounting bracket assembly 24. Support ring 12 which comprises a main channel 14 (FIG. 2) and defines a main central opening 16. Supporting 12 and central opening 16 are of a pre-determined size so as to be able to accept a wide range of commercially available flexible bag 150 sizes. Bag lock ring 18 is of the same oblong shape as support ring 12 and having a cross-sectional shape complementary to and mating with that of main channel 14. Lock ring 18 is attached to support ring 12 via a flexible attaching and positioning arm 20 L and 20 R which are attached to and extend in a perpendicular and co-planar outward direction from support ring 12. Main support arms 22L and 22R are set apart from each other, co-planarly, a predetermined distance sufficient enough to allow a indexing mounting bracket assembly 24 to be situated between arms 22L and 22 R and allowing a small clearance between mount bracket 24 and arms 22 L and 22 R.

Figure 3:
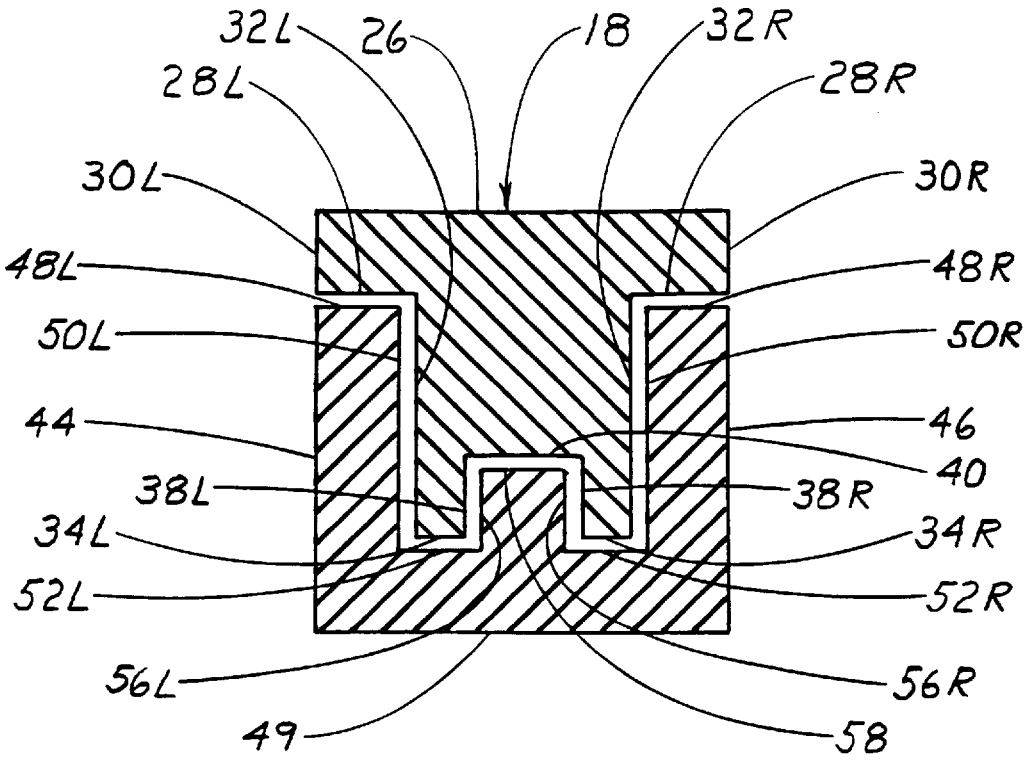
FIG. 3 shows a section view of the lock ring and support ring in close proximity to each other, with bag wall omitted, the view taken along lines "3—3" of FIG. 1.

Further illustrating support ring 12 and lock ring 18 (FIG. 3) shows lock ring 18 comprised of a top surface 26 and a parallel upper bottom surface 28 L and 28 R connected by a top sidewall 30 L and 30 R. A bottom surface 34 L and 34 R, parallel to top surface 26 and connected to upper bottom surface 28 L+R via a generally parallel bottom sidewall 32 L and 32 R. Bottom surface 34 L+R is interrupted by a groove 36 which is comprised of a generally parallel groove sidewall 38 L and 38 R connecting to a groove top surface 40. Thusly, it is seen that surfaces 28 L+R, 32 L+R, 34 L+R, 38 L+R, and surfaces 40 all connect to form a plurality of a corners 42. In close proximity to lock ring 18 is main support ring 12 (FIG. 4) comprised of a top surface 48 L and 48 R and a outer sidewall 44 and a generally parallel inner sidewall 46 which faces and defines main central opening 16. Perpendicularly connecting sidewalls 44 and 46 is a support ring bottom surface 49. Support ring 12 also having main channel 14 comprised of a channel sidewall 50 L connecting with a generally perpendicular channel bottom surface 52 L. Generally parallel to sidewall 50 L a channel sidewall 50 R connects to channel bottom surface 52 R. A abutment or land 54 protruding from bottom surface 52 L+R is comprised of a land sidewall 56 L connecting with and generally perpendicular with a land top surface 58 and a land sidewall 56 R which is generally parallel with land sidewall 56 L. Thus it is seen that sidewalls 44, 46, 50 L, 50 R, 56 L, 56 R, and surfaces 48 L+R, 52 L+R, and 58 all connect to form a corners 60. Also seen by the close proximity of lock ring 18 to support ring 12 is a labyrinth like gap or passageway 62 defined by the complementary and cooperating cross-sectional shapes of rings 12 and 18.

Further illustrating the relationship of support ring 12 and lock ring 18, (FIG. 4) shows the same main channel 14 and land 54, groove 36, and walls 32 as shown in (FIG. 3) but including additionally a protrusion 64 L and 64 R both extending horizontally outward from channel sidewalls 50 L and 50 R towards the center of channel 14 comprised of and defined by a protrusion radius 66 which is an arc with a radius length sufficient to cause protrusion 64 L and 64 R to bulge outwardly a predetermined distance from sidewalls 50 L and 50 R so as to cause protrusion 64 to tangentially intersect top surface 48 L and 48 R thus forming a smooth surface transition from surface 48 L+R into protrusion 64 L and 64 R. A undercut area 68 L and 68 R are provided in lock ring 18 comprised of and formed by a undercut radius 70 which is an arc with a radius length sufficient to cause undercut area 68 L and 68 R to have a shape and size complementary to and cooperating with protrusion 64 L and 64 R and located so as to cause the arc of undercut area 68 L+R to tangentially intersect bottom surface 28 thereby making a smooth surface transition from surface 28 into radius 70.

Figure 2:
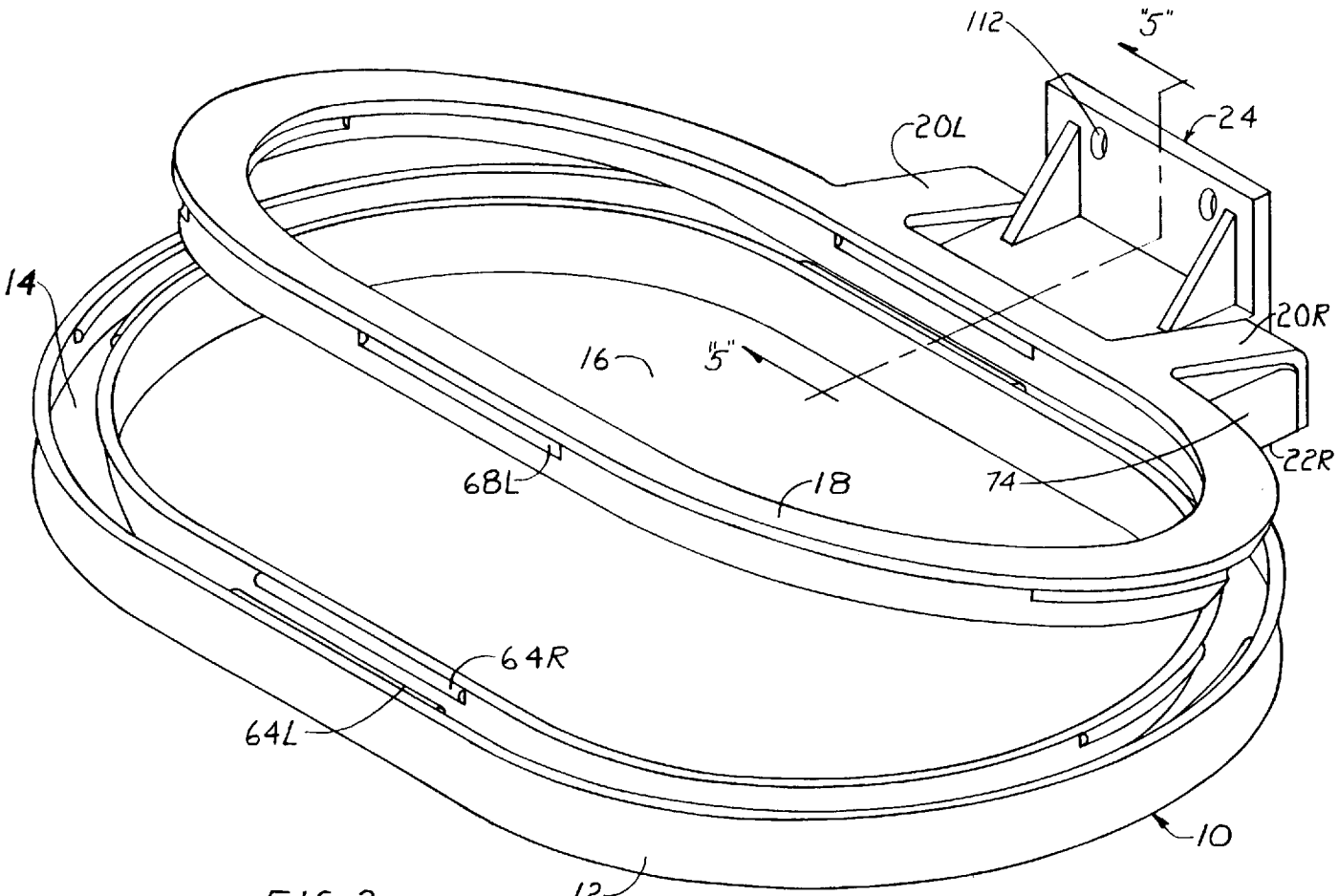
FIG. 2 shows a perspective view of a folding bag holder without bag, and lock ring open.
Figure 5:
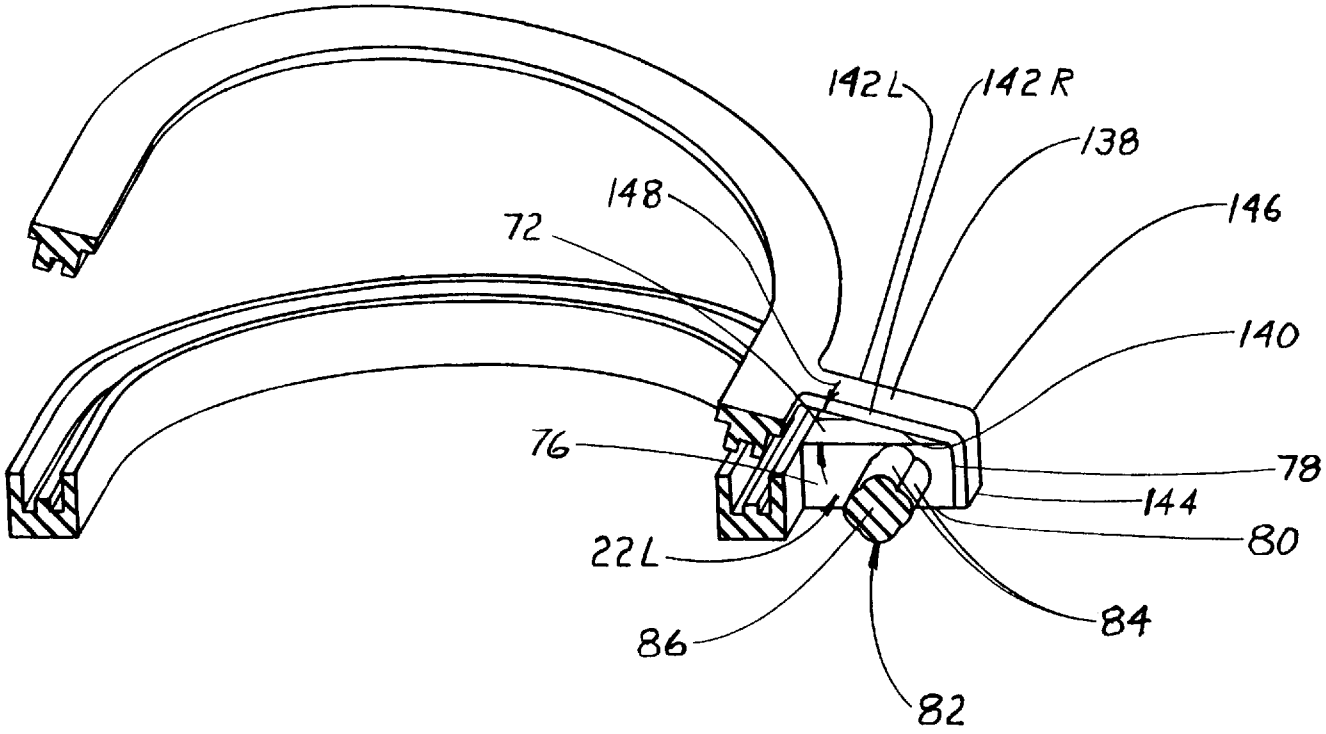
FIG. 5 shows a sectioned perspective view of a folding bag holder without mounting bracket assembly attached, taken along lines "5—5" of FIG. 2.

Further describing main support arms 22 L and 22 R (FIG. 5) comprised of and defined by a top surface 72 attached to and extending perpendicularly from the outer sidewall 44 of support ring 12 and as an extension of top surface 48 with top surface 72 parallel with and connected to a bottom surface 80 via a generally perpendicular inside surface 76 and a generally perpendicular outside surface 74 (FIG. 2). A end surface 78 (FIG. 5) connects perpendicularly to surfaces 72, 74, and 76. A elongated cam 82 is attached between support arms 22 L and 22 R, perpendicular to arms 22 and parallel and coplanar with support ring 12 and at a predetermined distance from ring 12 as to allow an indexing mounting bracket assembly 24 to rotate sufficiently unobstructed about elongated cam 82. Cam 82 comprised of and defined by a cam profile 86 being a series of connected arcs or a lobe 84 located equidistantly from and extending radially about the longitudinal central axis of cam 82.

Figure 6A:
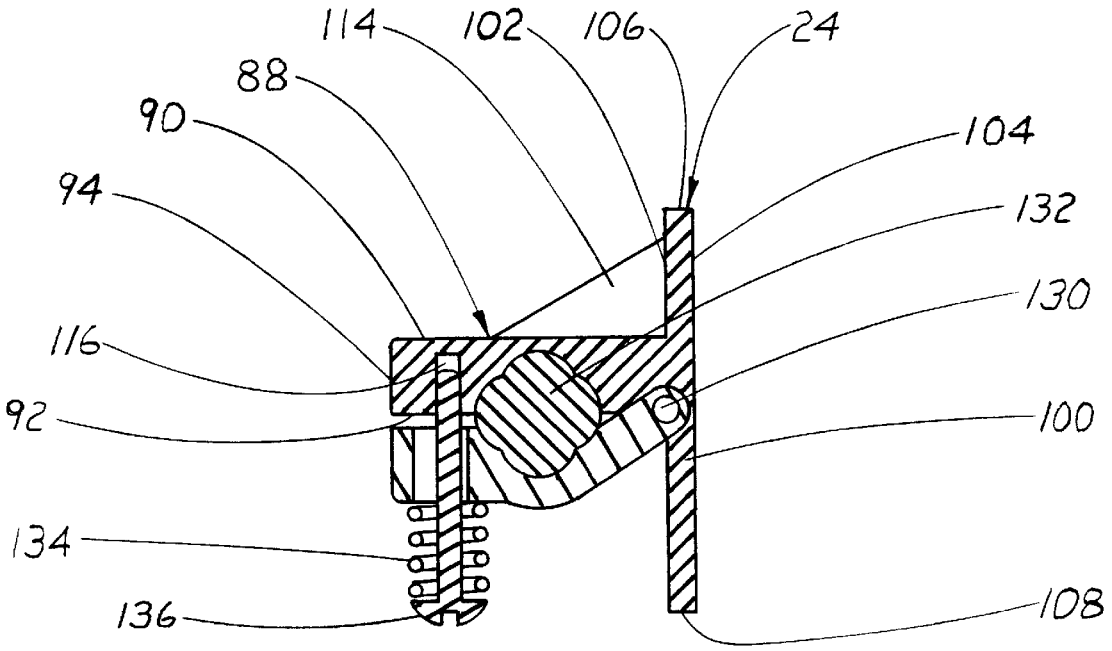
FIG. 6A is a sectioned view of a mounting bracket assembly with elongated cam, taken along lines "5—5" of FIG. 2.

Further defining indexing mounting bracket 24 (FIG. 6A) is a fixed cam indexing clamp 88 comprised of and defined by a top surface 90, a parallel bottom surface 92, and a generally perpendicular front surface 94 connected with surfaces 90 and 92. Bottom surface 92 is interrupted by and contains a elongated cam receiving channel 98 A which extends fully along the length of surface 92. Cam channel 98 A and 98 B (FIG. 6B) comprised of a cross-sectional profile complementary to and cooperating with elongated cam 82. A mounting plate 100 is attached to fixed clamp 88, comprised of a flat back surface 104, a generally parallel flat front surface 102, both connected by a generally perpendicular top surface 106, and a bottom surface 108. Mounting plate 100 also having a plurality of a mounting screw holes 112 (FIG. 2) having a predetermined size to accommodate common screws and fasteners. A stiffening gusset or a rib 114 (FIG. 6B) is attached perpendicularly to and extending between surfaces 102 and 90 having sufficient thickness and length so as to resist flexing stresses between plate 100 and clamp 88. A pivoting cam tensioning clamp 118 comprised of a top surface 120, a parallel bottom surface 122, a generally perpendicular front surface 126 connecting surfaces 120 and 122, and a angled upper back surface 124 and a angled lower back surface 125 connecting to surfaces 120 and 122 respectively. Top surface 120 is interrupted by a elongated cam receiving channel 98 B which extends fully along the length of surface 120. A pivot 130 is attached to pivoting clamp 118 and has its center point located at the intersection of surfaces 92 and 102 with the pivot longitudinal axis parallel with the longitudinal axis of fixed cam channel 98 A and 98 B. Pivot 130 also attaches to cam index clamp 88 with the center of pivot 130 located at the intersection of surfaces 92 and 102. Thus it is seen that when fixed cam index clamp 88 is attached to pivoting cam tensioning clamp 118 via pivot 130, elongated cam receiving channels 98 A and 98 B are situated directly opposite each other and cooperate to form a elongated cam cavity 132 (FIG. 6A). Elongated cam cavity 132 being of a predetermined size to accept elongated cam 82 within. A coil spring 134 is positioned to exert tension onto pivoting cam tensioning clamp 118. A tensioning screw 136 passes through spring 134, and through clearance hole 128 in pivoting clamp 118, and threads into a hole 116 in fixed clamp 88.

Further describing the pair of flexible attaching and positioning arms 20, (FIG. 5) comprised of a top surface 138 being an extension of lock ring top surface 26, a parallel bottom surface 140 being an extension of lock ring upper bottom surface 28, a side surface 142 L and 142 R, and a end surface 144. Surfaces 142 L and 142 R, and end surface 144 being generally perpendicular to and connecting top and bottom surfaces 138 and 140. Flexible attachment and positioning arms 20 L and 20 R, extending perpendicularly from lock ring top side wall 30 R and parallel to each other (FIG. 2) are positioned and spaced apart from each other so that each flexible arm 20 L+R lies directly above each main support arm 22 L+R. Arms 20 L and 20 R each having a bend 146 of a generally downward angle of less than 90 degrees with the radius commencing at the intersection of support arm top surface 72 and flexible arm bottom surface 140. Bend 146 radius is of a size sufficient to position flexible arms 20 close to the top surface 72 of support arm 22 while making a small angle 148 with surface 72.

A flexible bag 150 (FIG. 1) is bag or sack made of thin flexible material such as cloth or plastic, having an open end to receive contents, and some having loops extending from the open end to form handles. Flexible bag 150 being commercially available as trash bags, lawn or leaf bags, or plastic grocery bags, etc. Bag holder assembly 10 main parts such as support ring 12, lock ring 18, arms 20 and 22, cam 82, and mounting bracket 24 could be fabricated from any suitable semi-flexible material such as hard rubber or spring steel, but in this embodiment the preferred material would be a plastic such as polyethylene, polypropylene, or A.B.S. etc., and formed preferably by injection molding.

OPERATION

Figure 4:
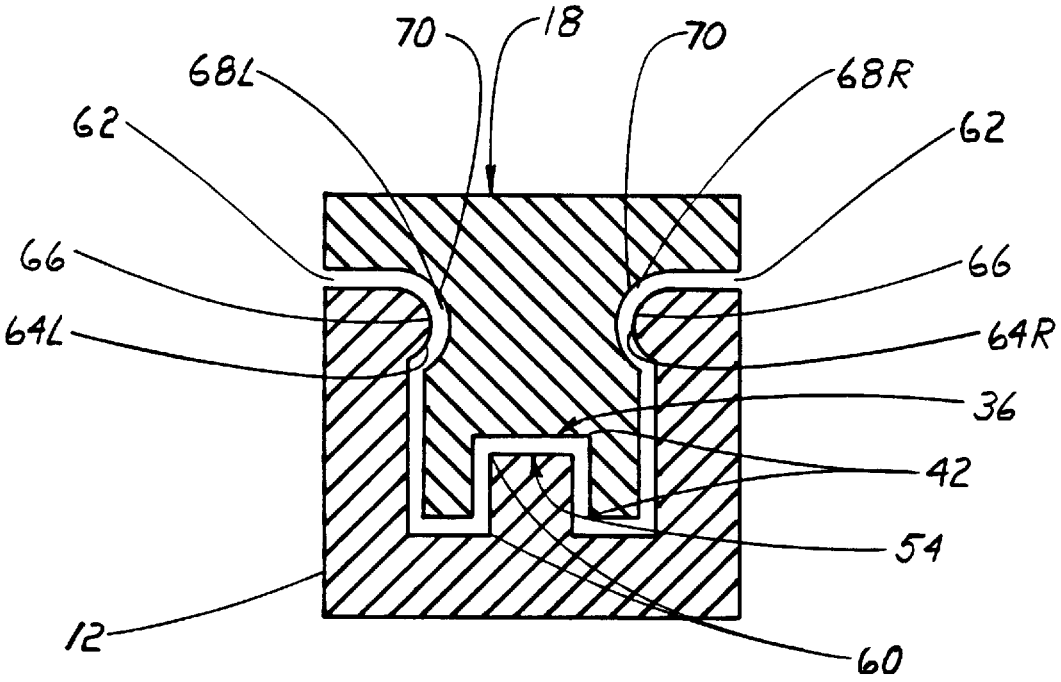
FIG. 4 is the same view as FIG. 3 but also including locking protrusions and undercuts, and taken along lines "4—4" of FIG. 1.
Figure 6B:
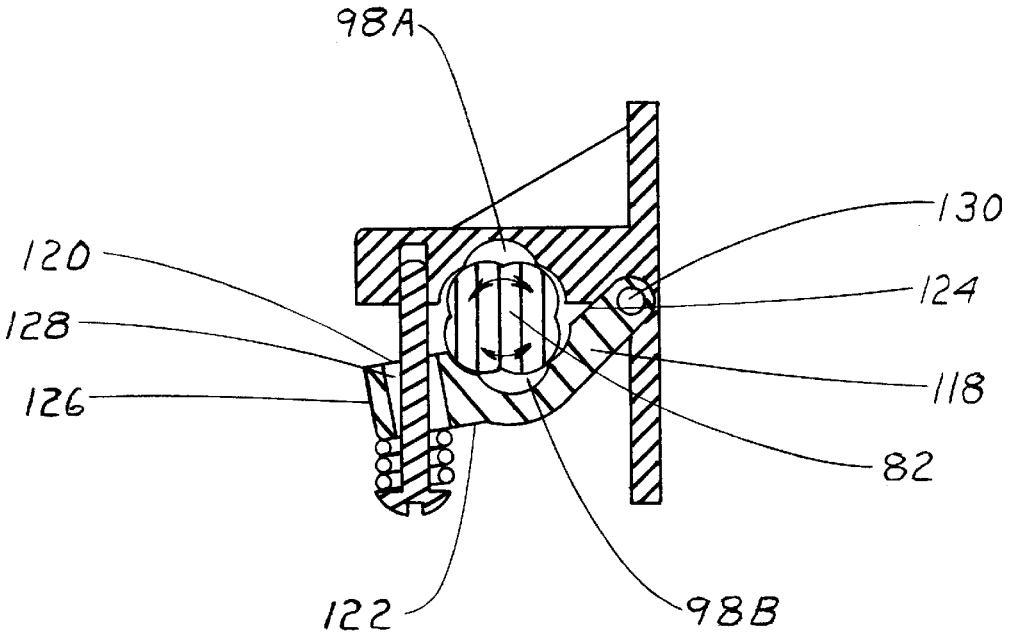
FIG. 6B is a sectioned view of a mounting bracket assembly in the pivoted open rotating position, taken along lines "5—5" of FIG. 2.
Figure 7:
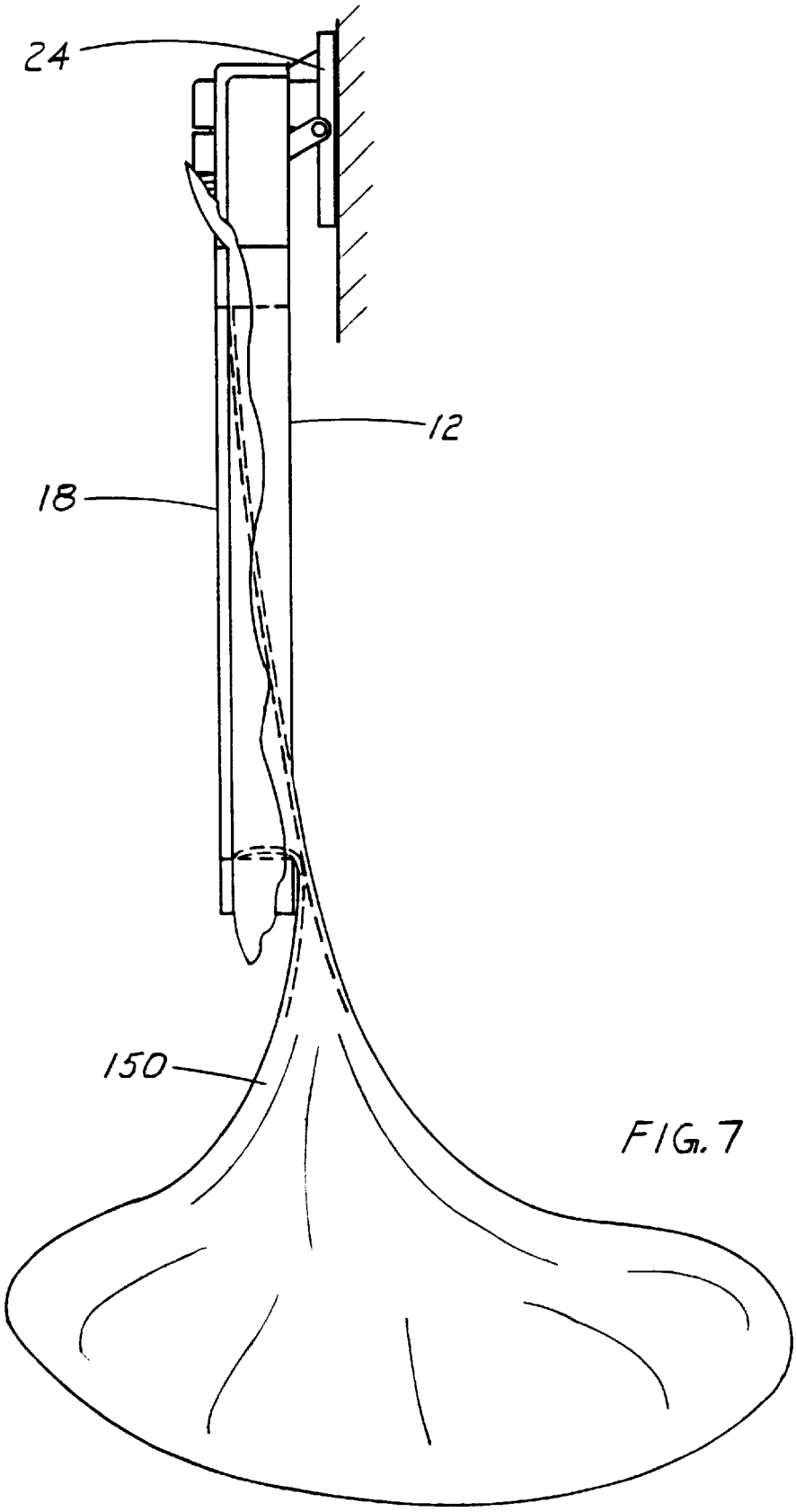
FIG. 7 is a right side view of a folding bag holder with bag, folded downwards into a vertical closed position.

The Folding Bag Holder of this invention is operated for example by attaching the device to any suitably flat surface such as a wall, a boat gunnel, the underside of a table or bench top, the inside of a cabinet door, or on to a utility cart. The device can be attached using common screws, nails, adhesives or the like. After attachment, bag support ring 12 is rotated to a generally horizontal position with bag lock ring 18 being held in an unlocked open position just above support ring 12 by flexible arms 20L and 20R. A flexible bag 150 has its open mouth end brought upwards through a central main opening, 16, of supporting ring 12 and then bag 150 top periphery is folded downward and completely around the outer periphery of support ring 12. Bag lock ring 18 which is hovering in aligned position just above support ring channel 14 is then pushed downward and "snapped" into channel 14 thereby trapping a peripheral portion of bag 150 into a labyrinth-like passageway 62 (FIG. 4). Because of the many turns and corners that the sidewall of bag 150 makes as it is held in passageway 62, bag 150 greatly resists any attempt to cause it to pull out of passageway 62. To further lock both rings 12 and 18 and bag 150 together, pairs of support ring protrusions 64 L+R and mating pairs of lock ring undercuts 68 L+R are provided at intervals around lock ring 18 and channel 14. As lock ring 18 engages into channel 14, the channel wall portion, which have the protrusions 64, flex outwardly and allow the cooperating undercuts 68 of lock ring 18 to snap into a mating and locked position thusly further trapping and holding bag 150. Indexing mounting bracket assembly 24 (FIG. 6A) clamps around elongated cam 82, holding cam 82 along with support ring 12, lock ring 18 and bag 150 in various indexed positions that are generally horizontal, generally vertical upward and generally vertical downward. Pushing on the bag holder assembly 10, causes the unit to index from one position to the next by causing cam 82 to rotate within elongated cam cavity 132 (FIG. 6B). Pivoting cam tensioning clamp 118 pivots open causing increased tension in spring 134 as elongated cam lobes 84 rotate out of mating position or phase with cavity 132. Increased tension of spring 134 causes bag holder assembly 10 to snap into the next indexed position as cam lobes 84 are forced to rotate back into phase again with cavity 132 by pivoting clamp 118 pivoting closed. Folding bag holder assembly 10 (FIG. 1) with bag 150 may be utilized by placing items or materials into bag 150 via main central opening 16. Before bag 150 has been fully filled, it may be desirable to close bag mouth in the interim between loadings or to fold the folding bag holder 10 out of the way in a confined area. These are accomplished by folding or swinging or rotating bag holder assembly 10 with bag 150 downward. It is seen (FIG. 7) that with the weight of the bag contents pulling downward on bag 150 and with support ring 12 in a generally vertical position, that a portion of a wall of bag 150 extends completely across main central opening 16 effectively closing off opening 16 thereby closing off the mouth of bag 150. Folding bag holder assembly 10 takes much less room when folded down, protruding substantially less distance outward from a mounting surface.

I claim:

1. I claim a pliable bag holder comprising:

(A) a generally oblong annular bag support ring, comprising a central bag receiving area and an upwardly facing open channel extending uninterruptedly around the bag support ring periphery;

(B) a generally oblong lock ring, comprising a size and shape corresponding and complementary to that of said bag support ring, allowing said lock ring to engage the support ring;

(C) a bag gripping labyrinth like passageway, formed by the cooperating complementary shapes of said support ring and said lock ring;

(D) said bag support ring further comprising means for retaining said lock ring in a locked position when the lock ring is engaged and cooperating with the support ring;

(E) said lock ring further comprising cooperating means for allowing said support ring to retain the lock ring in the locked position when both support ring and lock ring are engaged and cooperating with each other;

(F) a pliable bag with a continuous sidewall and a closed end, and an open end comprising a mouth extending around the perimeter of said pliable bag, said open end being inserted upwardly through said central bag receiving area of said bag support ring, then turned outwards across said open channel, then reverted downwards around the periphery of the support ring so as to have a portion of the sidewall of said pliable bag spanning said open channel and thereby confining a portion of the bag sidewall in said labyrinth like passageway as the lock ring engages the support ring;

(G) means for flexibly attaching to and positioning said lock ring in proximity to said bag support ring in order to best facilitate the installation of the pliable bag into said bag holder;

(H) a—first—support arm, attached to and extending outwardly from the bag support ring periphery;

(I) a second support arm, extending coplanarly with said first—support—arm, the second arm being parallel to and located a predetermined distance from the first arm;

(J) an elongated index cam with appropriate cross sectional shape comprised of a plurality of lobes, so as to allow for a predetermined number of horizontal, vertical, and angled indexed holding positions of bag holder and bag, said elongated index cam having one end attached to the first support arm and a second end attached to the second support arm thereby spanning normally between the support arms and coplanarly with said bag support ring;

(K) a fixed elongated cam receiving clamp, comprising an elongated cam receiving channel having a cross sectional shape and size complementary to and mating with a portion of said elongated index cam;

(L) a pivoting elongated cam receiving clamp, comprising an elongated cam receiving channel having a cross sectional shape and size complementary to and mating with a portion of said elongated index cam, the pivoting clamp being attached to the fixed elongated cam receiving clamp via a pivot, said pivot being located so as to align the fixed clamp with said pivoting clamp so that both of the elongated cam receiving channels cooperate to grip around said elongated index cam with both channels simultaneously receiving and mating with said elongated index cam;

(M) means for variably and flexibly tensioning the pivoting clamp against the fixed clamp causing a clamping force to be exerted by both clamps against and around said elongated cam, as the cam index is rotated relative to the fixed clamp and pivoting clamp, said lobes of said elongated index cam rotate alternately in and then out of phase with respect to the mating receiving channels, as said elongated index cam lobes rotate out of phase with said cam receiving channels, the pivoting clamp pivots to a more open position thereby causing an increased tension in said flexible tensioning means, said increased tension thereby effecting a larger breakout force necessary to rotate the cam along with said pliable bag holder from one indexed position to another;

(N) a mounting plate both of attached to the elongated cam clamps, having slots or holes to allow for common fasteners to be utilized to attach the folding bag holder and bag assembly to a suitable surface.

* * * * *